US006273258B1

(12) United States Patent
Piacenza

(10) Patent No.: US 6,273,258 B1
(45) Date of Patent: Aug. 14, 2001

(54) SYSTEM OF IDENTICAL MODULAR CONTAINERS WHICH CAN BE PILED UP ON TOP OF ONE ANOTHER, IN PARTICULAR FOR FOODSTUFFS

(75) Inventor: Giuseppe Piacenza, Muzza di Cornegliano Laudense (IT)

(73) Assignee: SNIPS S.r.l., Milan (IT)

( * ) Notice: Subject to any disclaimer, the term of this patent is extended or adjusted under 35 U.S.C. 154(b) by 0 days.

(21) Appl. No.: 09/494,931

(22) Filed: Feb. 1, 2000

(51) Int. Cl.[7] ..... B65D 21/00
(52) U.S. Cl. ..... 206/503; 220/23.6; 220/23.83
(58) Field of Search ..... 220/23.83, 23.86, 220/23.4, 23.6; 206/503

(56) References Cited

U.S. PATENT DOCUMENTS 3,339,725 * 9/1967 Hamilton ..... 220/23.6 X
3,384,259 * 5/1968 Hoffstadt ..... 220/23.86 X
3,811,559 * 5/1974 Carter ..... 220/23.6 X
4,760,921 * 8/1988 Licari ..... 220/23.4 X
5,086,926 * 2/1992 Paige et al. ..... 220/23.83 X

FOREIGN PATENT DOCUMENTS 1062621 7/1959 (DE) .
1145992 3/1963 (DE) .
9414617 11/1994 (DE) .

* cited by examiner

*Primary Examiner*—Steven Pollard
(74) *Attorney, Agent, or Firm*—Hedman & Costigan, P.C.

(57) ABSTRACT

A system of identical modular containers which can be piled up on top of one another, characterized in that between one container (11) and another, releasable means of reciprocal clamping are envisaged.

2 Claims, 7 Drawing Sheets

SYSTEM OF IDENTICAL MODULAR CONTAINERS WHICH CAN BE PILED UP ON TOP OF ONE ANOTHER, IN PARTICULAR FOR FOODSTUFFS

The present invention refers to a system of identical modular containers which can be piled up on top of one another, to be used particularly, but not exclusively, for the storage and transportation of foodstuffs.

In the sector of so-called "household goods", plastic containers for foodstuffs are known which are used for the storage and transportation of foodstuffs of various kinds.

For instance, it is well known that it is necessary to place, in refrigerators or freezers or in some other cold environment, fresh and/or cooked food for the purpose of storing it ready for use within relatively short periods.

Plastic containers for foodstuffs are also used to transport the aforesaid food from one place to another, for example, when transferring from one house to another or during trips or excursions, etc.

In order to meet the needs mentioned above, containers that can be piled up one on top of another have already been proposed. However, these containers present the drawback of not having a positive-seal means of closing between one container and another, a fact which may give rise to the problems referred to in what follows.

First of all, the containers are piled up without there being a real seal-type means of closing, and this can lead to the contents coming out and an inadequate storage with loss of the flavour of the food, and also an undesirable contamination of the refrigerator.

In addition, picking up and transporting the pile of containers is not easy or safe, in that a careless or clumsy operation could easily cause sudden and unexpected separation of the piled containers, and the contents could consequently get spilt.

Finally, it is difficult to separate a single container from the rest of the pile at a time, for example the one on the top or the one on the bottom.

The general purpose of the present invention is to overcome the above-mentioned drawbacks of the known art by creating a system of identical modular containers that can be piled up on top of one another, in which a safety seal is provided between one container and another, picking-up and transporting of the entire pile can be carried out safely, and it is also possible to separate one or more of the containers at a time easily from the rest of the pile.

The above purpose is achieved by a system of containers as claimed in the main claim attached and in the subordinate claims.

The structural and functional characteristics of the invention and its advantages with respect to the known art will be more clearly understood from an examination of the following description referring to the attached drawings which illustrate a practical example of embodiment of the invention. In the drawings.

Figure 1:
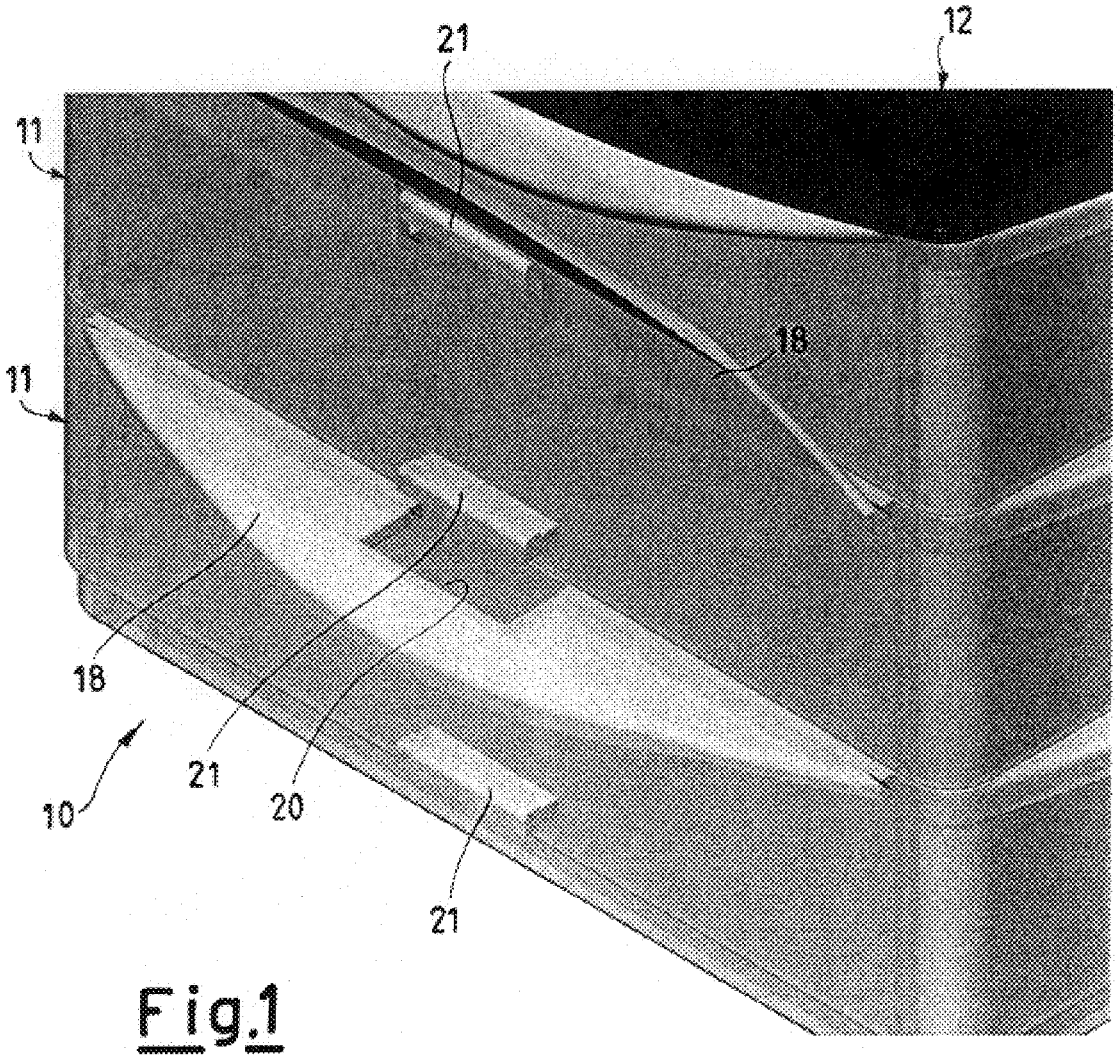
FIG. 1 is a perspective view illustrating the positive-seal item between one container and another in a system of modular containers made according to the principles of the invention.

With reference to FIG. 1 of the drawings, the system of modular containers in question is designated, as a whole, by 10 and comprises a plurality of containers 11 that are identical to each other and can be piled on top of one another, and possibly also comprises a top lid 12.

The containers described in the embodiment provided as a non-limiting example are rectangular in plan view and have rounded edges, but could also have any other geometrical shape suitable for the purpose.

Figure 2:
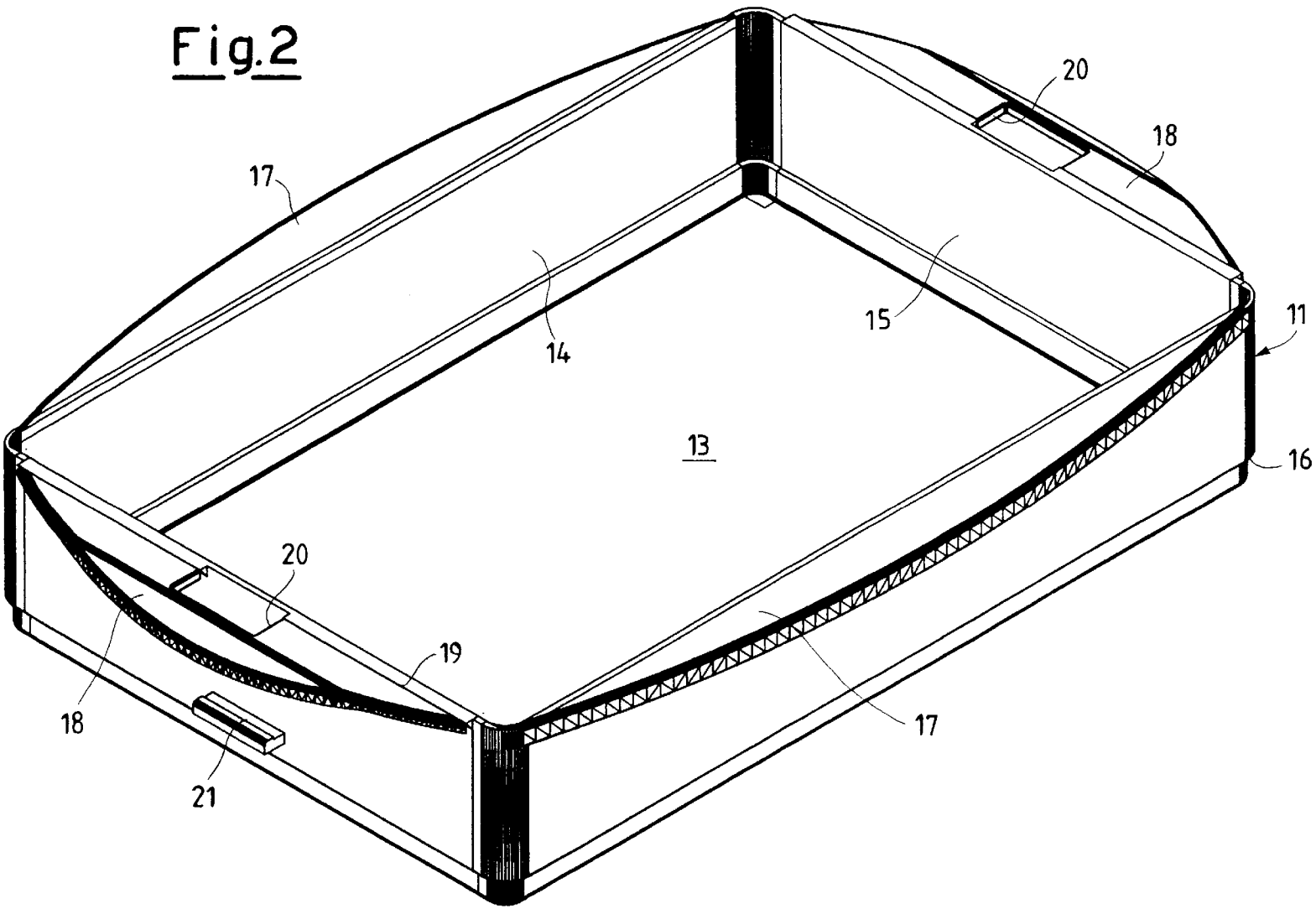
FIG. 2 is a perspective view of a single container.
Figure 3:
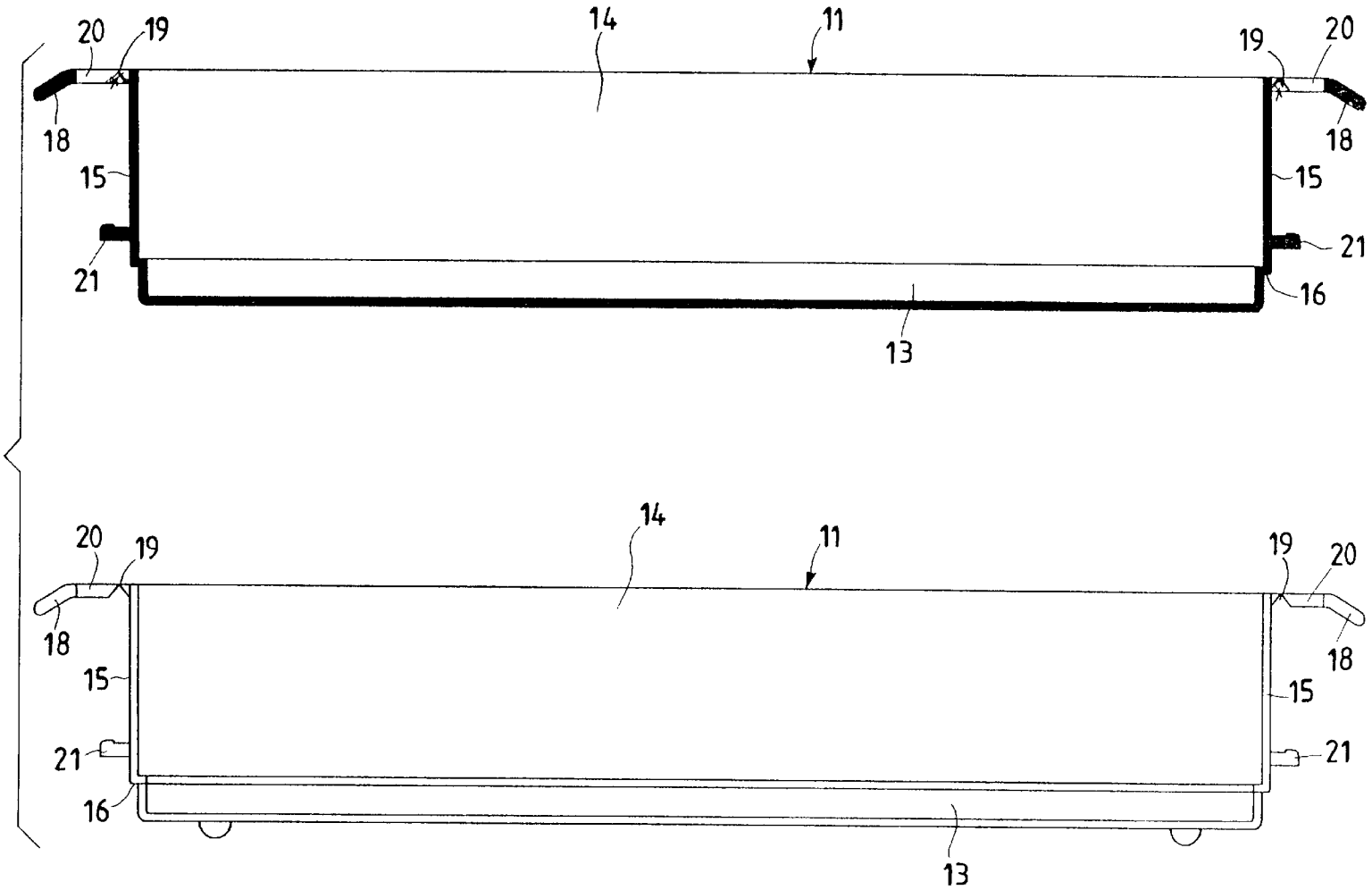
FIG. 3 is an exploded front view which illustrates, longitudinally and in cross section, two containers that can be piled up, one set on top of the other.
Figure 4:
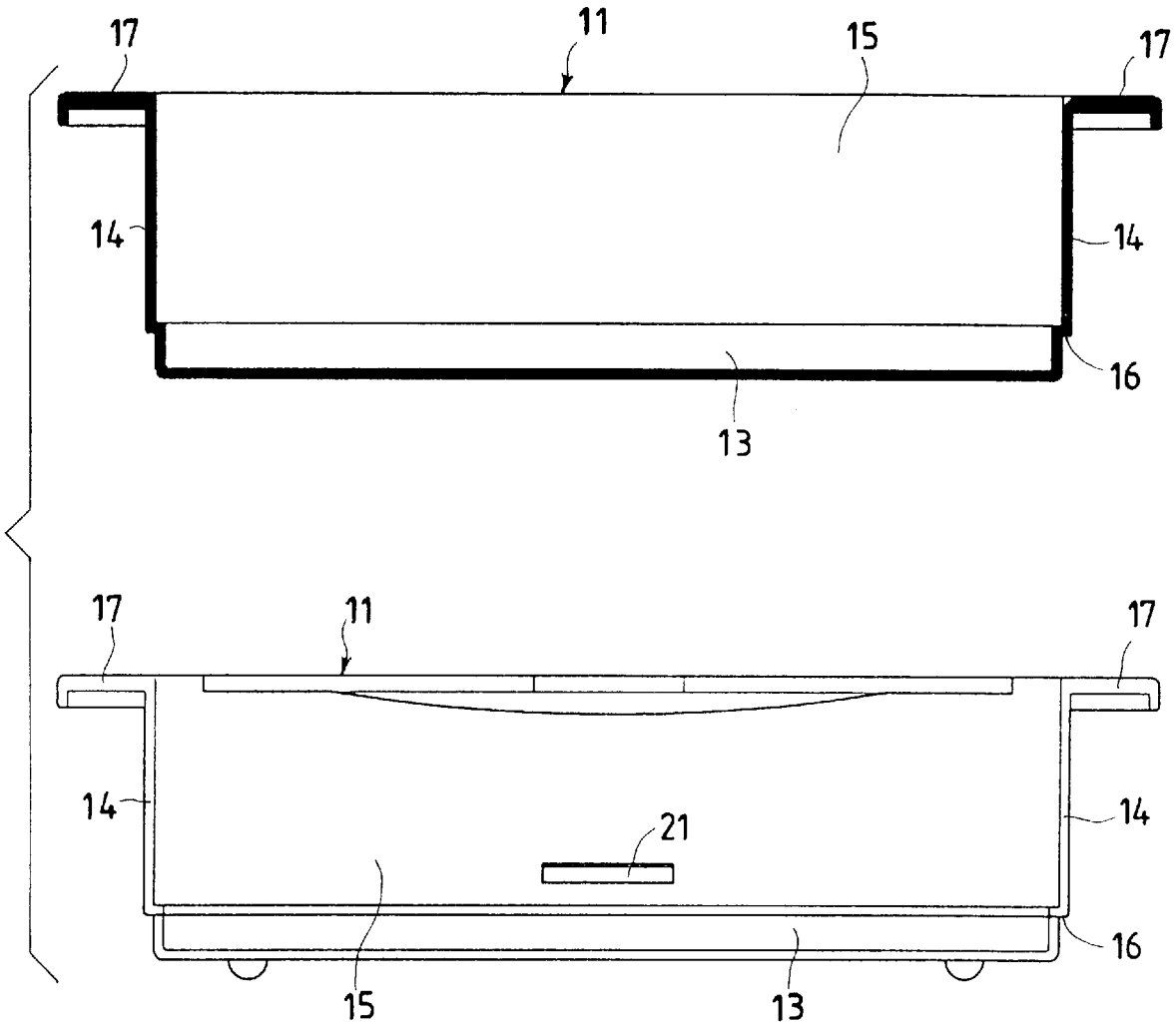
FIG. 4 is a view similar to that of FIG. 3 illustrating the same containers in front view transversely and in cross section.

As is clearly shown in FIGS. 2–4, each container 11 is provided with a restricted bottom section 13, which, together with the longitudinal perimeter walls 14 and transverse perimeter walls 15, identifies a perimeter undercut 16.

In this way, a number of containers 11 can be piled on top of one another, as shown in FIG. 1, by inserting—with a slight interference—the bottom section 13 of one container in the top of the container set underneath. For this purpose, the external dimensions of the bottom section 13 and the internal dimensions at the top of each container are complementary, and in any case such as to ensure a fit with a slight interference between the surfaces that come into in contact.

The reference number 17 designates hand-grips which extend from the longitudinal top edges of each container 11.

According to the present invention, on the sides of each container 11 (transverse sides) there is provided a positive clamping system between one container and another.

More precisely, the said clamping system consists of a flap 18 hinged in 19—for example by means of a line of less resistance—to the top edge of the container.

Each flap 18 presents, at its centre, an opening 20 designed for clamping, as shown in FIG. 1, onto a tooth 21 protruding, in vertical alignment, from the container above, in the vicinity of the bottom section 13.

In this way, it is evident how a plurality of piled containers, for example as shown in FIG. 1, can be positively sealed together by simply clamping the opening 20 of a flap 18 of a container 11 set underneath onto the tooth 21 of a container 11 set on top.

For the above purpose, the operation of piling one container on top of another (after the contents have been placed inside) is performed with the flaps 18 lowered or open in the position shown in FIG. 2, whilst the positive closing of one container on top of another is performed by rotating the flaps upwards about the hinge line 19 and engaging, as mentioned above, the opening 20 with the tooth 21.

The flap 18 may, for instance, be made of a relatively pliant or soft thermoplastic material, either the same as or different from the rigid thermoplastic material of which the containers are made.

Figure 5:
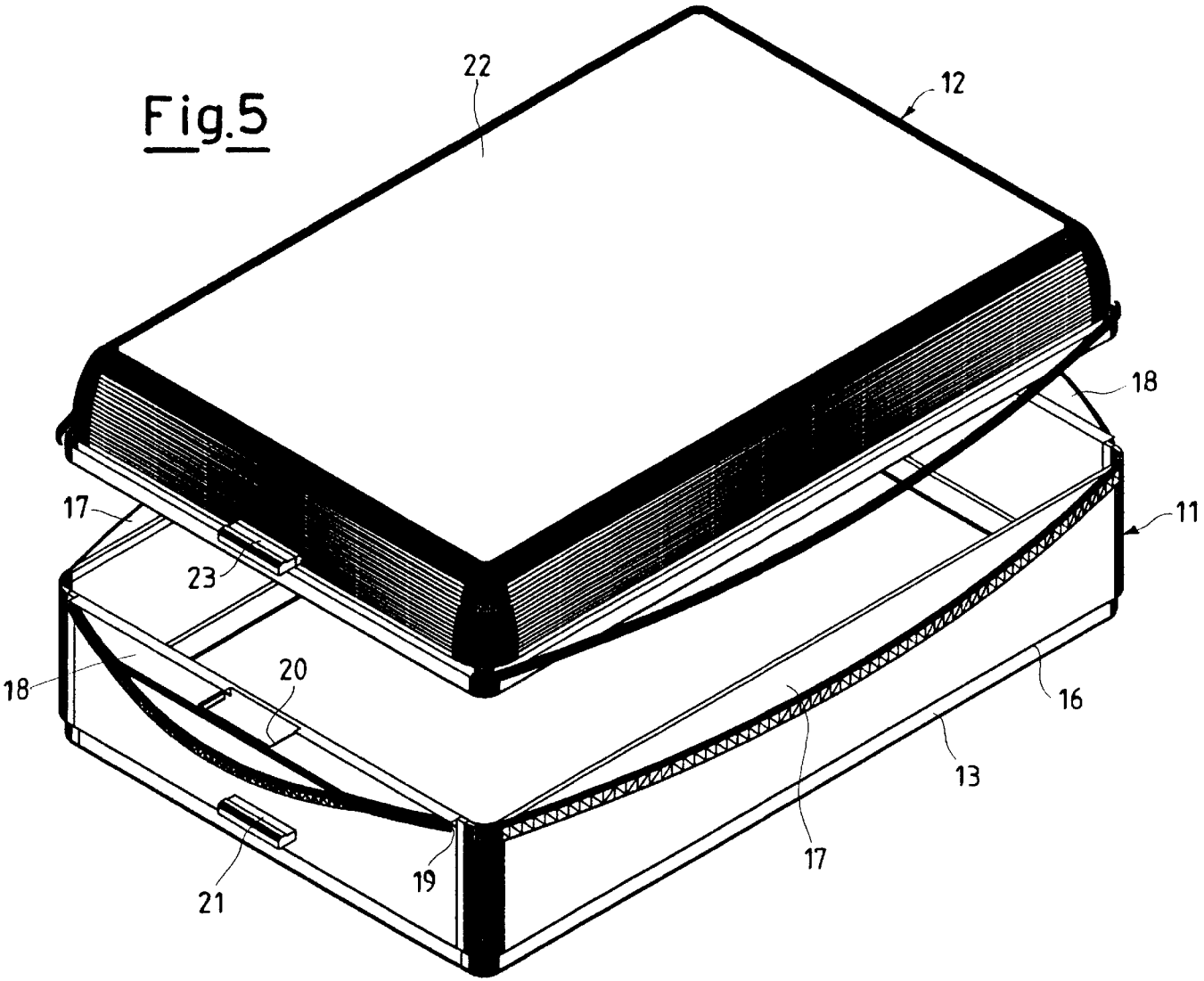
FIG. 5 is a view illustrating a container with corresponding lid in exploded view.
Figure 6:
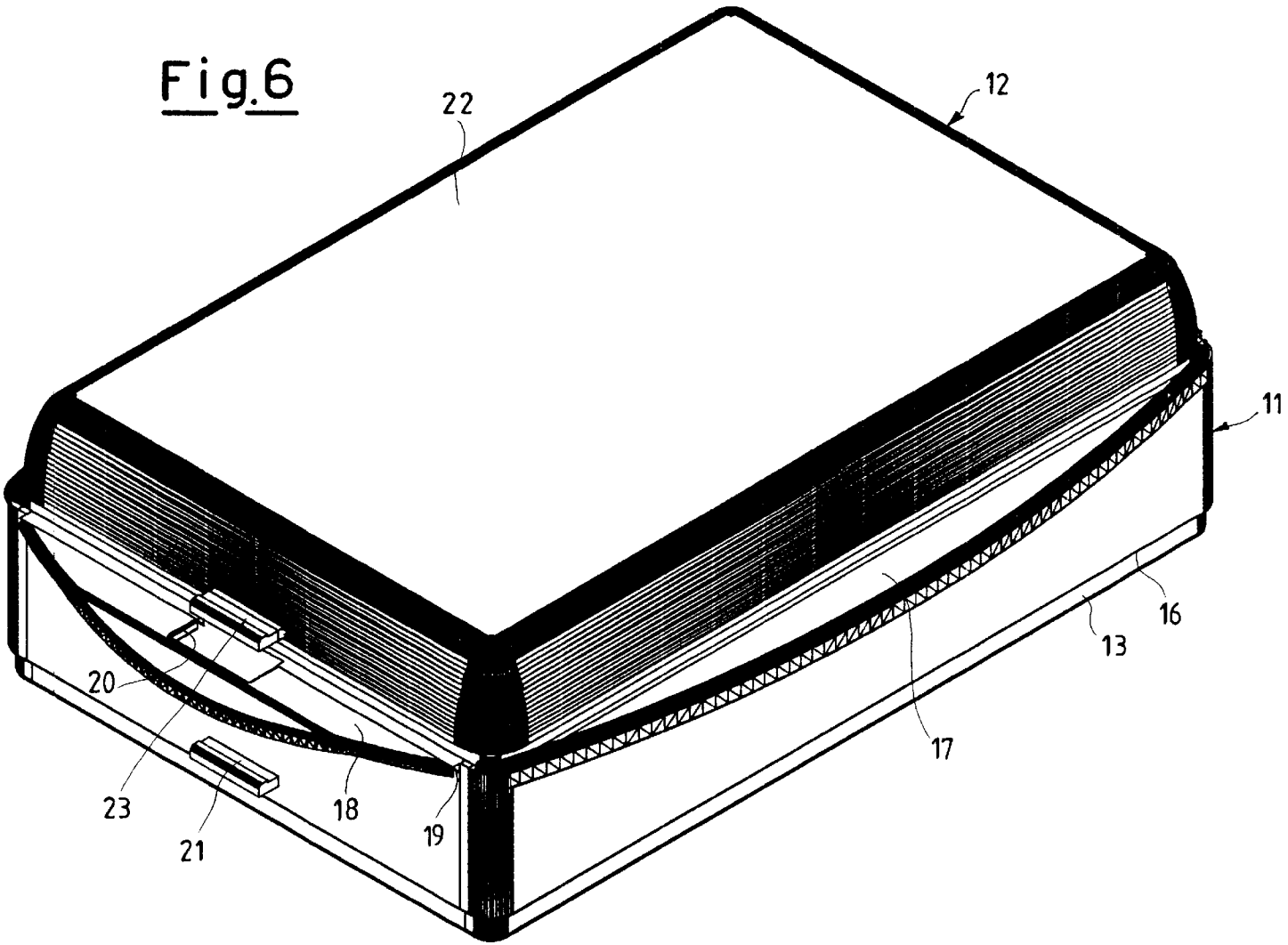
FIG. 6 is a view similar to that of FIG. 5 illustrating the lid fitted onto the container but not clamped on it.
Figure 7:
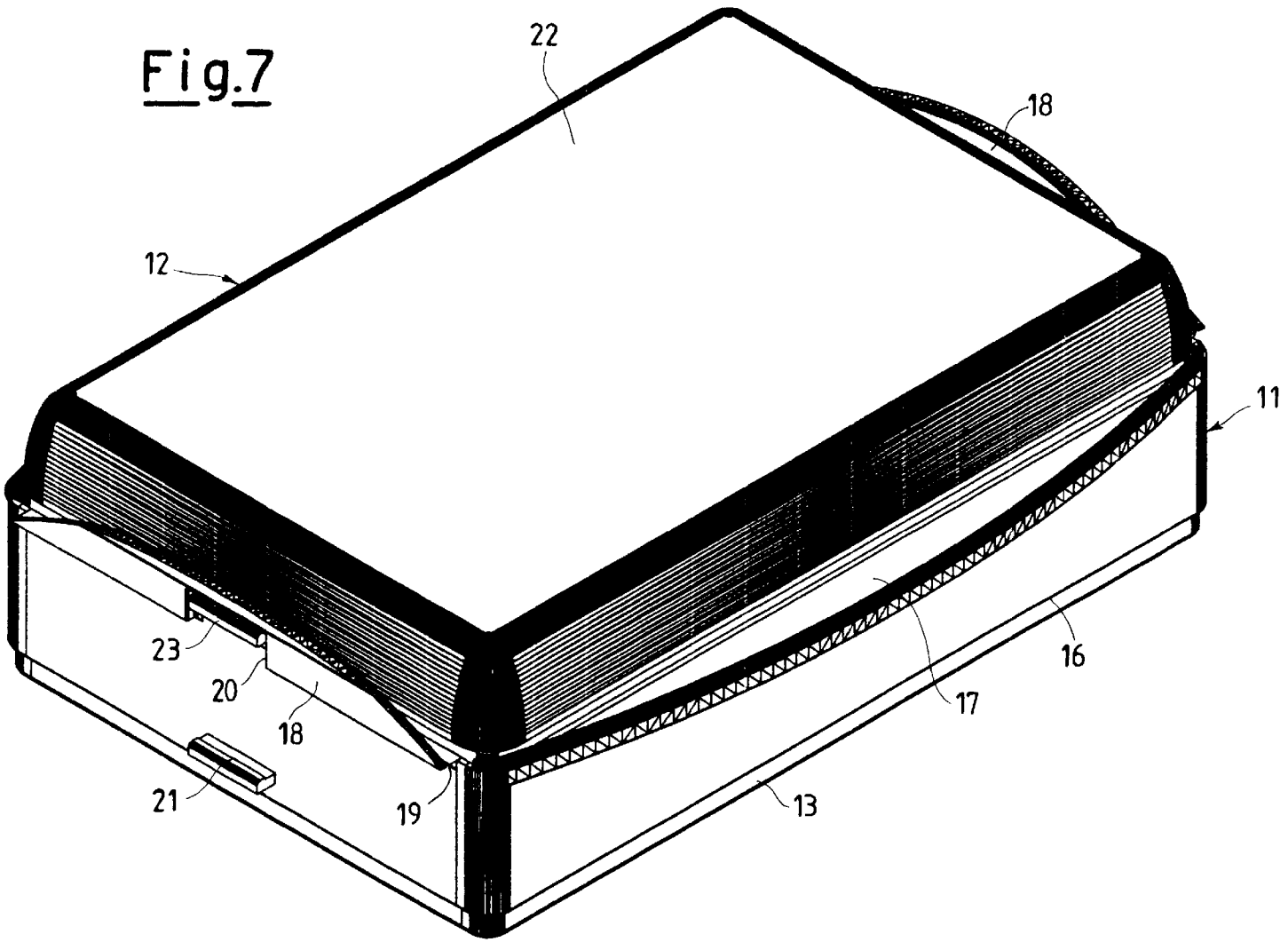
FIG. 7 is a view similar to that of FIG. 6 illustrating the lid positively fixed to the container.

The top container of a pile or the single container can be provided with a closing lid 22 (FIGS. 5–7) which has on its sides a tooth 23 for clamping by means of the flap 18 of the container 11 beneath, as clearly illustrated in the drawings.

In this way, the purpose mentioned in the preliminary part of the description is achieved of making a system of identical modular containers which may be piled on top of one another, where the containers making up the pile are interconnected positively by means of a chain-type closing system, which, however, does not involve all the containers at the same time but enables separation of one or more containers at a time from the rest of the pile in conditions of absolute safety, i.e., without any danger of the pile being overturned.

The system proposed by the invention moreover ensures a sealed means of closing between the containers, which is able to prevent any food of a fluid nature accidentally getting spilt out of the containers either during storage or during transportation, so that the flavour of the food is preserved perfectly without any pollution of the surrounding environment.

Of course each container may be subdivided into a number of compartments; i.e., it may comprise a number of modules that can be fitted together when the pile is formed.

The scope of the invention is defined by the ensuing claims.

What is claimed is:

1. A system of open top containers each having a bottom (13), longitudinal perimeter walls (14) and transverse perimeter walls (15), each container being adapted to be piled up on top of another, with a releasable means of reciprocal clamping, comprising:

a clamping means attached to a top edge of each of said containers, said clamping means comprising a flap (18) hinged at said top edge, said flap (18) having at its center an opening (20) designed to engage retention means, said retention means being provided on said transverse perimeter walls (14);

said retention means comprising retention teeth (21) which extend from said transverse perimeter walls.

2. The system according to claim 1, further comprising a lid (22) which completely covers said container and is provided with a releasable means of clamping said lid to a container, said releasable means of clamping comprising retention teeth (23) extending from the transverse sides of said lid (22), to engage openings (20) of said hinged flaps (18) on said transverse perimeter walls of said container.

* * * * *